US005364177A

United States Patent [19]

Ugalde

[11] Patent Number: 5,364,177

[45] Date of Patent: Nov. 15, 1994

[54] CONVERTIBLE COMPUTER WORKSTATION

[75] Inventor: Carlos V. Ugalde, San Dimas, Calif.

[73] Assignee: Continental Engineering Group, Inc., Irwindale, Calif.

[21] Appl. No.: 704,462

[22] Filed: May 23, 1991

[51] Int. Cl.[5] ..... A47B 21/00

[52] U.S. Cl. ..... 312/194; 312/223.3; 312/208.1

[58] Field of Search ..... 312/7.2, 223.3, 194, 312/196, 208.1, 208.2; 248/188.5, 139

[56] References Cited

U.S. PATENT DOCUMENTS

| | | | |
|---|---|---|---|
| 4,562,482 | 12/1985 | Brown | 312/208 |
| 4,669,789 | 6/1987 | Pemberton | 312/7.2 |
| 4,828,342 | 5/1989 | Stefan | 312/208 |
| 5,094,514 | 3/1992 | Grosch | 312/194 |

FOREIGN PATENT DOCUMENTS

| | | | |
|---|---|---|---|
| 2215197 | 4/1988 | United Kingdom | 108/136 |

OTHER PUBLICATIONS

*GF Furniture Systems,* 1984, p. 30 table desks top row, second from right.

*Global* catalog U88, 1987, p. 27, "Classic PC Workstation" on top of page.

*Primary Examiner*—Kenneth J. Dorner
*Assistant Examiner*—Gerald A Anderson
*Attorney, Agent, or Firm*—Christie, Parker & Hale

[57] ABSTRACT

A convertible computer workstation comprising a desk having a horizontal working surface, a front panel, a vertical side panel located at one end of the working surface to support the working surface, a second vertical side panel located at the opposite end of the working surface to support the working surface, a third vertical support panel located approximately mid-way between the first and second side panel, a plurality of computer component shelves located between one side panel and the third support panel, a retractable keyboard drawer with a rear surface located between the opposite side panel and the third support panel, a monitor housing for supporting a computer monitor located behind the keyboard drawer comprising a horizontal working surface located within the desk working surface and hingedly connected to the desk front panel, a first side panel, a second side panel, a bottom panel, and a rear panel, all attached to the underside surface of the monitor housing working surface, means to lock the monitor housing in a first position, and means to automatically change the monitor housing from a first position to a second position.

11 Claims, 4 Drawing Sheets

CONVERTIBLE COMPUTER WORKSTATION

REFERENCE TO RELATED APPLICATION

This application is related to co-pending U.S. design application Ser. No. 07/634,499, filed on Dec. 27, 1990 and assigned to a common assignee.

FIELD OF THE INVENTION

This invention relates to a computer workstation, and more particularly, to a computer workstation which allows conversion from a desk surface into a computer center instantly simply by sliding out the keyboard so that the monitor compartment opens automatically to its working position, providing maximum viewing and computer operator comfort.

BACKGROUND OF THE INVENTION

Today's computer workstation market is a highly competitive market offering a multitude of designs. However, most workstations that offer work surfaces do not give the operator the convenience or the amount of space needed to spread work or even provide a comfortable writing surface.

Computer workstations have been designed in an attempt to solve the problems of inadequate and uncomfortable working spaces. Once such design is illustrated in U.S. Pat. No. 4,669,789, in which the computer monitor compartment is supported underneath the work surface, and is brought to a viewing position by lifting the entire work surface. The problem with this design is that the workstation must be utilized as a computer workstation without the use of a working surface, or as a conventional desk without the use of the computer.

A second computer workstation design which offers both the capability of a computer workstation and an additional working surface is illustrated in U.S. Pat. No. 4,562,482. In this design, the monitor is supported by a bracket which is attached to an internal supporting structure in the computer workstation. The problem with this design is that the monitor must be manually rotated from its forward to its rear position and an additional piece must be inserted to cover the keyboard to take advantage of the entire working surface.

Thus, there exists a long-felt need in the art for a new and improved workstation which provides a computer workstation with a work surface which can be automatically converted entirely to a desk surface.

SUMMARY OF THE INVENTION

The present invention provides an improved convertible computer workstation which eliminates the problems of existing computer workstations, and is simple and inexpensive to manufacture.

The computer workstation of the present invention generally comprises a desk and a monitor housing. The desk comprises a top working surface, a front panel, two side support panels, and a third support panel located approximately mid-way between the two side support panels. Depending upon whether the computer workstation is made for a right-handed or left-handed individual, located between the third support panel and one of the side support panels are a number of shelves to support the central processing unit, the printer, and the printer paper. Additionally, there is a drawer for pens, pencils, notepaper and the like. Located between the third support panel and the other side support panel is a keyboard drawer and the monitor housing.

The keyboard drawer is actually supported by the third support panel and one of the side support panels, whereas the monitor housing, in addition to being supported by the third support panel and one of the side support panels, is also supported by the front panel. The monitor housing consists of a top working surface, which lies flush with and fits into a corresponding cut-out section of the working surface of the desk, two side panels, a bottom panel, and a back panel. There is no front panel in the monitor housing, so when the monitor housing is raised to viewing level, the monitor can be seen.

The monitor housing remains in a first or closed position when the computer is not in use. In this position the top working surface of the monitor is flush with the desk working surface therefore creating an entire working surface. The monitor is locked into this position by a mechanism such as a peg protruding from the back of the keyboard drawer which mates with a bore located in the front end surface of a monitor housing side panel.

When the computer is to be used the monitor housing can automatically be raised to a second or viewing position. This position is accomplished by pulling the keyboard drawer forward releasing the peg from the bore which engages a lifting mechanism. The lifting mechanism is a spring biased mechanism such as a gas strut much like those used in the automotive industry to lift hatchbacks or trunk lids. The lifting mechanism slowly and continuously raises the monitor housing to its viewing position while cushioning the monitor from any sudden jerks or bumps.

DETAILED DESCRIPTION

Figure 1:
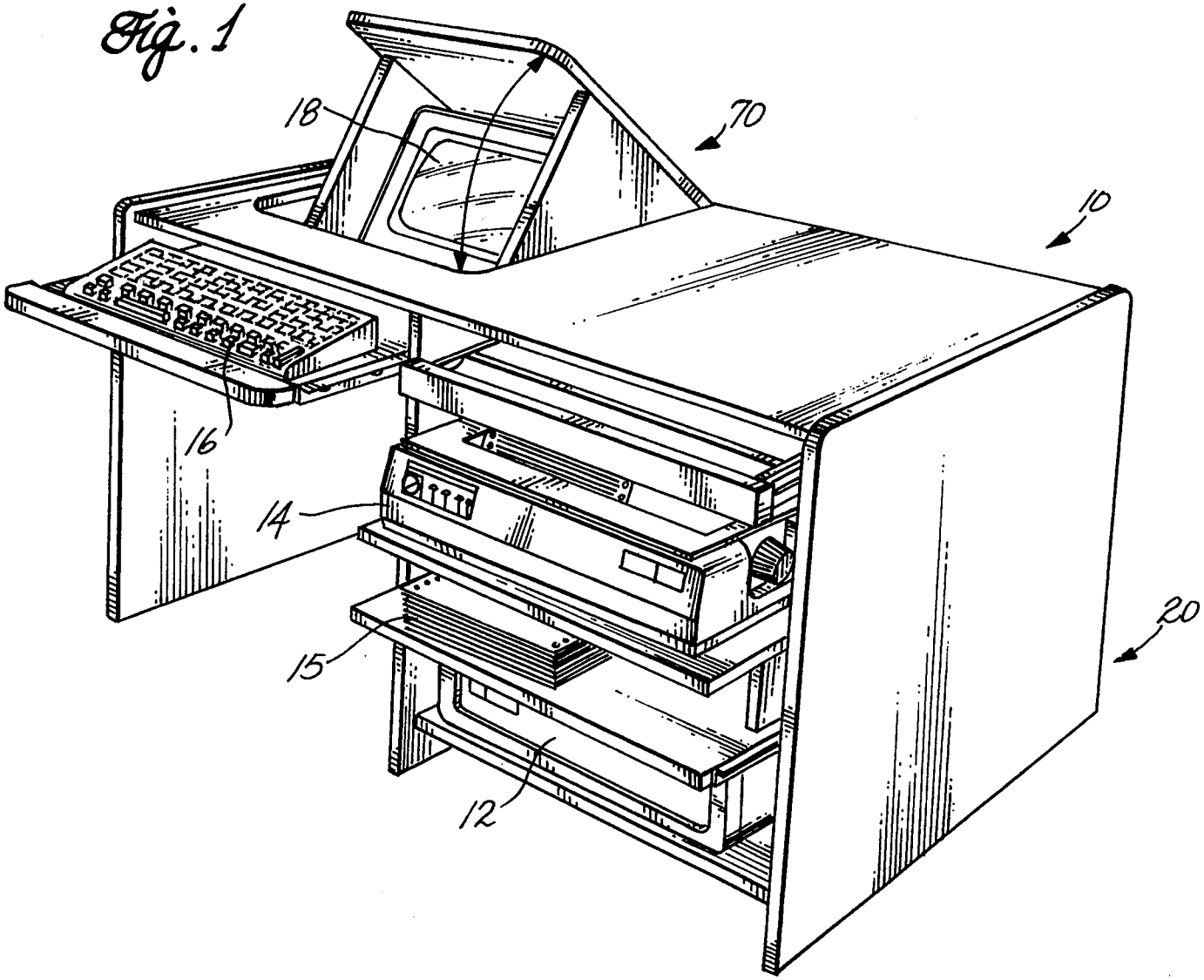
FIG. 1 is a perspective view of a computer workstation arrangement according to the principles of this invention, with the computer components shown in phantom for illustration purposes only and is not considered to be a part of the invention.

Referring to the drawings, FIG. 1 illustrates a convertible computer workstation 10 constructed in accordance with the principles of this invention. The workstation 10 comprises a desk 20 and a monitor housing 70. The monitor housing supports the monitor 18. The desk supports the monitor housing, as well as the rest of the computer components which are the central processing unit 12, printer 14, printer paper 15, and the keyboard 16.

Figure 2:
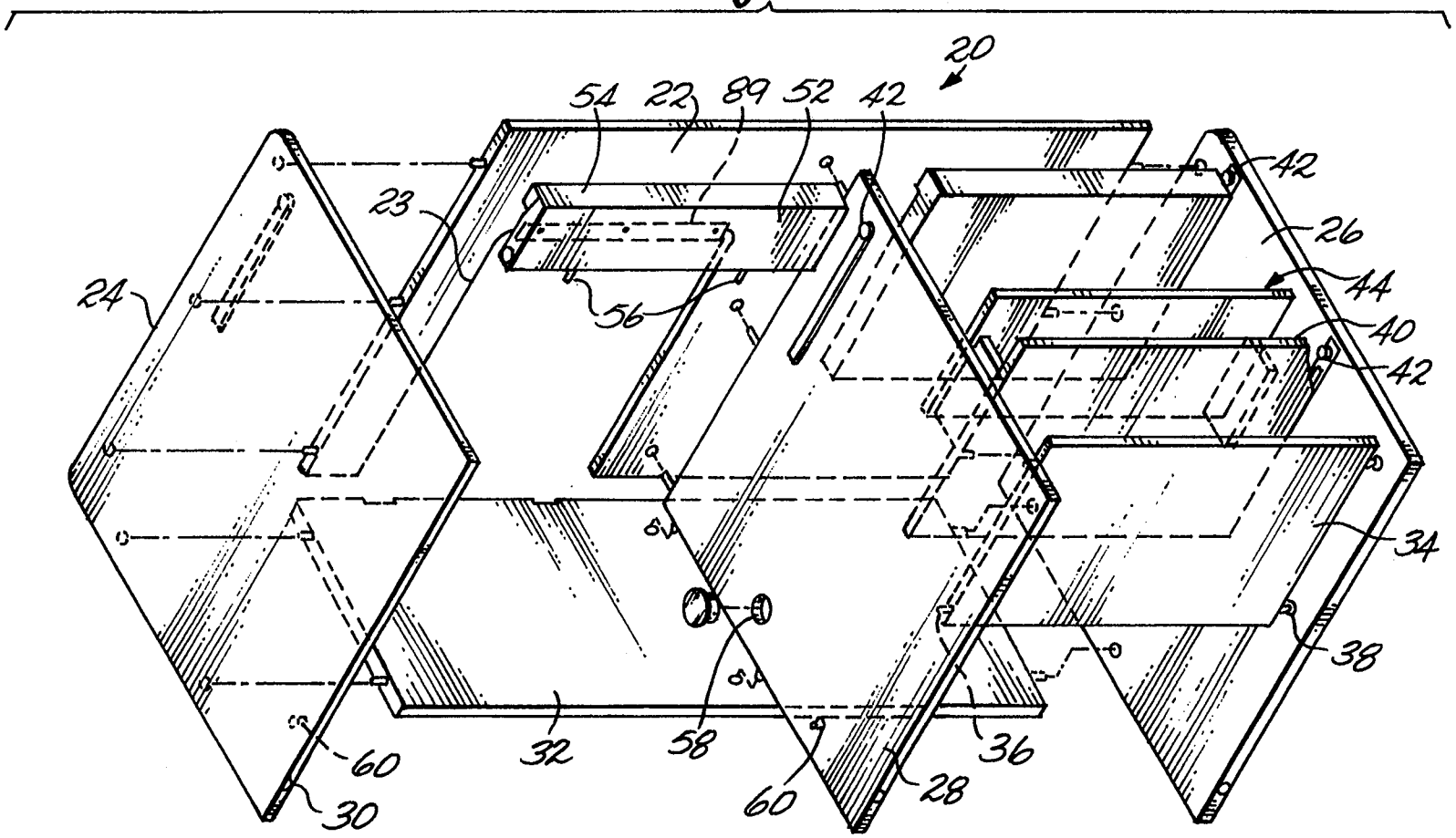
FIG. 2 is a perspective, exploded view of the desk component of the invention.

As can be seen in FIG. 2, the desk comprises a horizontal working surface 22 containing a cut-out portion 23 for the monitor housing. The working surface is supported by a left side panel 24, a right side panel 26, and a third intermediate panel 28 located approximately mid-way between the left and the right side panels. Located on the bottom edge of each of these three panels are rubber feet 30 used to engage and cushion the computer workstation on the floor. Perpendicular to each of the three panels, as well as the working surface, is a front panel 32 which forms the front of the desk.

Located between the intermediate panel and the right side panel are the computer component shelves. Located towards the bottom is the central processing unit (CPU) shelf 34 which supports the CPU. The shelf is secured to the side and intermediate panels by pins 36 in each end which mate with corresponding holes 38 in the intermediate and side panels. The shelf can also be secured to the side and intermediate panels with conventional hardware, such as wood screws. These two alternative means of securing the components together are representative methods for securing together all the components of the desk and the monitor housing, except where stated otherwise.

The next shelf above the CPU shelf is the printer paper shelf 40. Here is an instance where the paper shelf is not connected to the side and intermediate panels by the two previously discussed methods. Instead, the paper shelf is connected to the intermediate and side panels by the use of tracks 42. A track is located at either side of the paper shelf wherein one half of the track is secured to each edge of the paper shelf, and the other half of the track is secured to the inside surface of the right side panel and the inside surface of the intermediate panel. By using a track, the printer paper shelf can be pulled in and out in order to restock the shelf with printer paper and retrieve printed paper.

Resting upon the paper shelf, and attached thereto by one of the two previously discussed methods, is the printer shelf 44. The printer shelf comprises a top panel 45, a right side panel 46, and a left side panel 47. The right and left panels are attached to the paper shelf. Cut into the surface of the top panel of the printer shelf is a paper slot 48 which allows the paper to be fed from the paper shelf, through the printer shelf and into the printer. The printer shelf is only half as deep as the paper shelf which allows the printed paper exiting the printer to collect on the back side of the paper shelf.

The final component between the right side panel and the intermediate panel is a utensils drawer 50. The utensils drawer is used to store pens, pencils, note pads and the like. The utensils drawer is attached to the right side panel and the intermediate panel by the use of tracks, just like those used with the paper shelf.

Located between the left side panel and the intermediate panel at the top is the keyboard drawer 52. The keyboard drawer is attached to the panels likewise by a track. On the front of the keyboard drawer is a built-in wrist rest 54. This feature is included so that the operator's wrists can rest upon the drawer to avoid fatigue. Protruding from the rear of the keyboard drawer are two pegs 56, the significance of which will be discussed below.

A hole is located in the intermediate panel so that the electrical wiring from the keyboard and the monitor may be connected to the CPU. Located on the inside surface of the left side panel and the intermediate panel are engaging mechanisms 60 which help support the monitor housing.

Figure 3:
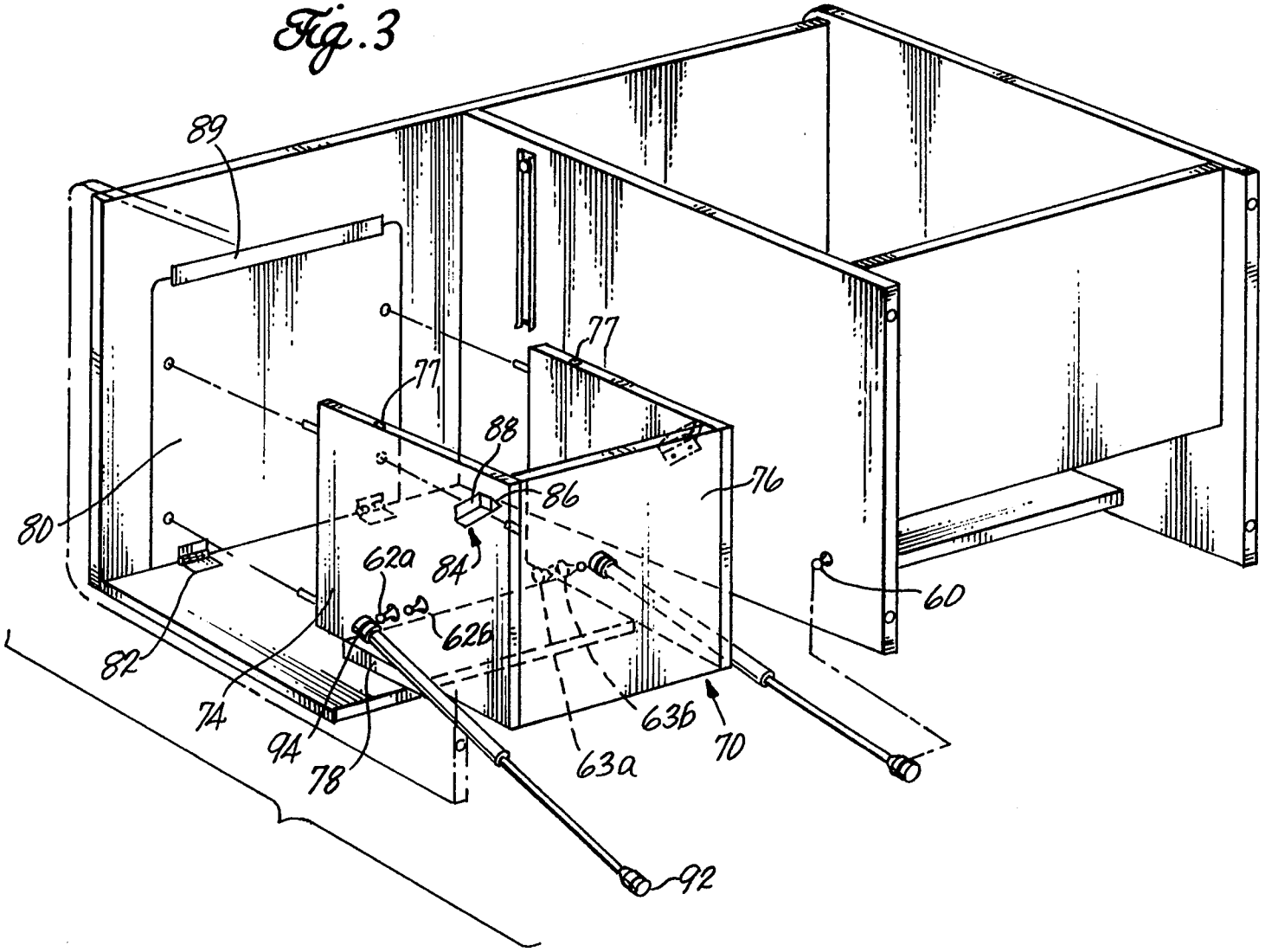
FIG. 3 is a perspective view illustrating the relationship between the desk component and the monitor housing component of the present invention.

FIG. 3 illustrates the monitor housing 70 which comprises a bottom panel 72, a left side panel 74, a right side panel 76, a rear panel 78, and a top panel 80. The bottom panel, left and right side panels, and rear panel are all fastened by either of the two methods previously discussed. The top panel of the monitor housing is connected to the rear panel of the desk with conventional hinges 82. The top panel, when closed, can also be utilized as a writing surface. The top panel is maintained flush with the desk working surface by bumper 89 attached to the underneath surface of the desk working surface at cut-out 23. The bumper resists any downward force exerted on the top panel when used as a writing surface. Once the top panel is connected to the front panel of the desk, the remaining assembled monitor housing components are attached to the bottom surface of the top panel.

Located on the outside surface of the left side panel and the right side panel of the monitor housing are left engaging mechanisms **62*a* and 62*b* and right engaging mechanisms 63*a* and 63*b*. Also located on the side panels of the monitor housing are foam bumpers 84. The foam bumpers comprise a metal angle bracket 86 and a foam cushion 88**. The bumpers are attached so that when the monitor housing is raised to its viewing position, the bumpers rest upon the bottom surface of the desk working surface and help to cushion any vibration exerted on the desk.

The monitor housing is raised to the viewing position by two spring-loaded pneumatic guides 90. Depending upon the weight of the monitor, the heavy ends 92 of the pneumatic guides are attached to the appropriate engaging mechanisms located on the sides of the monitor housing. The other or lighter ends 94 of the pneumatic guides are attached to the engaging mechanisms 60 located on the inside surfaces of the left side panel (not shown) of the desk and the intermediate panel of the desk.

In operation, the monitor housing is maintained in its closed position when the computer is not in use, wherein the top panel is flush with the working surface of the desk. The monitor housing is locked in the closed position by the two pegs protruding from the backside of the keyboard drawer mating with bores 77 in the front edges of the left side panel and right side panel of the monitor housing, thereby biasing the print-loaded pneumatic guides. In the closed position, the computer workstation has an unobstructed working surface which includes the working surface of the desk and the top surface of the monitor housing top panel.

Figure 4:
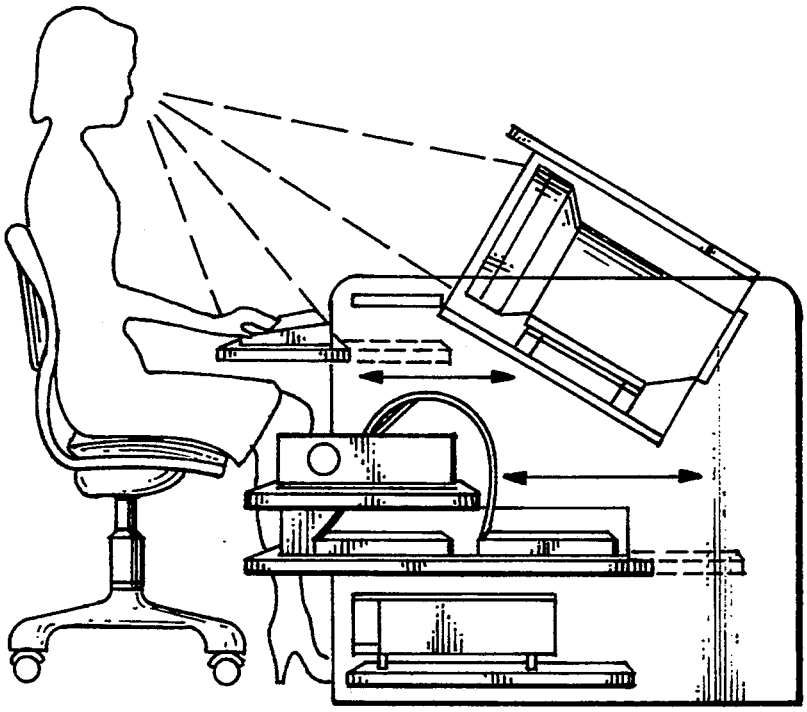
FIG. 4 is a cross sectional right side view of the computer workstation in the open position.

As can be seen in FIG. 4, when the user desires to operate the computer, the monitor housing is automatically raised to its viewing position by simply pulling out the keyboard drawer which releases the pegs from the bores, thereby disengaging the bias against the spring-loaded pneumatic guides. The guides exert an upward force which slowly raises the monitor housing to the open position until the foam bumpers engage the bottom surface of the desk working surface.

The spring-loaded pneumatic guides support the monitor housing in the open position until the user is finished operating the computer. To return the monitor housing to the closed position, the user simply pushes down on the top panel of the housing, overcoming the resistance of the pneumatic guides, until the top panel is again flush with the working surface of the desk and resting on bumper 89. The user then pushes the keyboard drawer back to its closed position, thereby engaging the pegs into the bores and locking the monitor housing in place.

Although the present invention has been described and illustrated with respect to a preferred embodiment thereof, it is to be understood that it is not to be so limited since changes and modifications may be made therein which are within the full intended scope of this invention as hereinafter claimed.

What is claimed is:

1. A computer workstation comprising:

a desk, said desk comprising:

a first horizontal working surface, a desk front panel, a desk rear panel, a first vertical desk side panel located at one end of the working surface to support the working surface, a second vertical desk side panel located at the opposite end of the first working surface to support the first working surface, a vertical desk support panel located intermediate the first and second desk side panels, a plurality of computer component shelves located between the second vertical desk side panel and the desk support panel, and a retractable keyboard located between the first vertical desk side panel and the desk support panel;

a retractable keyboard drawer with a rear panel located between the opposite side panel and the third support panel;

a monitor housing for supporting a computer monitor hingedly mounted to the desk and located behind the keyboard drawer and below the first horizontal working surface in a closed position, said monitor housing comprising:

a second horizontal working surface located within the first horizontal working surface, a first monitor housing side panel with a front surface, a second monitor housing side panel with a front surface, a bottom monitor housing panel, and a rear monitor housing panel, the monitor housing panels each being joined together and the monitor housing being attached to an underside surface of the second horizontal working surface;

at least one aperture formed in the front surface of either the first side panel or the second side panel of the monitor housing;

at least one engagement means protruding the rear of the keyboard drawer for engagement with the aperture to hold the monitor housing in the closed position; and mechanical means for biasing the monitor housing into an open position whereby the monitor housing automatically moves to the open position in response to disengagement of the engagement means from the aperture.

2. A computer workstation according to claim 1 wherein the means for biasing comprises at least one spring-biased continuous-release mechanism with one end heavier than the other, wherein the heavier end is attached to a side panel of the monitor housing and the other end is attached to either one side panel of the desk or the desk support panel, such that when the engagement means is withdrawn from the aperture the continuous release mechanism slowly and continuously raises the monitor housing to the open position.

3. A computer workstation according to claim 2 wherein the means for biasing the monitor housing comprises a spring-biased continuous-release mechanism attached to a side panel and a desk support panel of the monitor housing.

4. A computer workstation of claim 2 wherein the spring-biased continuous-release mechanism can be attached at different positions on the side panel of the monitor housing to correspond with varying weights of a computer monitor.

5. A computer workstation of claim 1 wherein a bumper mechanism is attached to each side panel of the monitor housing to cushion the housing when the housing is raised to the open position.

6. A computer workstation of claim 1 wherein the plurality of computer component shelves includes a stationary shelf to support a central processing unit (CPU).

7. A computer workstation according to claim 1 wherein the plurality of computer component shelves includes a retractable paper shelf to store printer paper.

8. A computer workstation according to claim 7 wherein substantially shorter shelf comprising a top member, a left support member, and a right support member are secured to each other and to the paper shelf to support a printer.

9. A computer workstation of claim 8 wherein the top member of the printer shelf has a symmetrically located slot to allow unprinted printer paper to pass from the paper shelf to the printer.

10. A computer workstation of claim 1 wherein a retractable utensils drawer is located above the plurality of computer component shelves.

11. A computer workstation of claim 1 wherein the retractable keyboard drawer includes a front surface defining a wrist rest.

* * * * *